US005522958A

United States Patent [19]

Li

[11] Patent Number: 5,522,958

[45] Date of Patent: Jun. 4, 1996

[54] TWO-STAGE KRAFT COOKING

[75] Inventor: Jian Li, Montréal, Canada

[73] Assignee: Pulp and Paper Research Institute of Canada

[21] Appl. No.: 276,804

[22] Filed: Jul. 18, 1994

[51] Int. Cl.[6] ..... D21C 3/26

[52] U.S. Cl. ..... 162/19; 162/39; 162/45; 162/86

[58] Field of Search ..... 162/19, 39, 45, 162/47, 59, 61, 86

[56] References Cited

U.S. PATENT DOCUMENTS

| | | | |
|---|---|---|---|
| 4,601,787 | 7/1996 | Fagerlund | 162/45 |
| 4,690,731 | 9/1987 | Hartler | 162/45 |
| 4,849,052 | 7/1989 | Grant | 162/39 |

OTHER PUBLICATIONS

Sjoblom, K., "A new technique . . . results of mill trials", Sep. 1983, TAPPI Journal, pp. 97–102.

Hartler, Nils, "Extended Delignification in Kraft Cooking—a new concept", 1978, Svensk Pappersidning 15: 483, pp. 1–2.

Andrews, E. K. "RDH® Kraft Pulping—Liquor Profiling to Extend Delignification, Decrease Effluent Liability & Improve Productivity & Pulp Properties," 1989 TAPPI Pulping Conf. 1989, 607–625.

Jian et al. "Extended Delignification with a Prolonged Mild Counter–Current Cooking Stage", APPITA 91, 1991, p. 221.

MacLeod J. M. "Is Unbleached Softwood Kraft Pulp Strongest at 30 Kappa Number", Paperi ja Puu, 73(8), 1991, p. 773.

Mera et al. "Extended Delignification, An Alternative to Conventional Kraft Pulping," TAPPI, 71(1), 1988, 132–136.

Pu et al. "Kinetic Model of Softwood Kraft Pulping and Simulation of RDH® Process." Appita, 44(6), 1991, p. 399.

Pursiainen, et al. "Mill–scale Experiences of Extended Delignification w/the Super–Batch® Cooking Method" TAPPI, 73(8), 1990, 115–122.

Tikka, et al. "Delignification Patterns and Pulp Strength Formation inside Batch Digesters Operated by Displacement & Conventional Modes", CPPA Spring Conf. Jasper, Alberta, May 1990 1–9.

Tormund et al. "New Findings on Sulphide Chemistry in Kraft Pulping Liquors," Int. Symp. Wood & Pulping Chem. 1989, Raleigh, NC 247–254.

Wizani W. et al. "The Enerbatch® Kraft Pulping Process—Progress in Pulp Uniformity & Extended Delignification" 1992 TAPPI Pulping Conf. Boston 1037–1046.

Engstron, J. et al. "Black Liquor Pretreatment in Kraft Cooking." Paperi JA PUU—Paper and Timber vol. 76/No. 1–Feb. 1994.

*Primary Examiner*—David L. Lacey
*Assistant Examiner*—Dean T. Nguyen
*Attorney, Agent, or Firm*—Swabey Ogilvy Renault

[57] ABSTRACT

A method for the production of kraft pulps in a digester, by modifying the cooking chemical concentration, and lignin concentration profiles during the cook, has provided extended delignification and improved selectivity in a simpler way than has previously been possible. The cooking is performed at an elevated temperature in two stages. The first stage liquor is a mixture of 1) the spent liquor of the second stage and 2) a portion of the conventional charge of fresh cooking chemicals needed for the complete cook. The second stage liquor is made up by adding an aqueous diluent, for example, fresh water or washing filtrate to the remaining portion of the fresh cooking chemicals.

14 Claims, 9 Drawing Sheets

TWO-STAGE KRAFT COOKING

BACKGROUND OF THE INVENTION

1. Field of the Invention

This invention relates to producing, without sacrificing pulp strength and yield, unbleached kraft pulps with minimal residual lignin to reduce the consumption of bleaching chemicals.

2. Description of the Prior Art

In the conventional batch cooking process, a digester is filled with wood chips and charged with a cooking liquor, which in the kraft process is an aqueous solution of sodium hydroxide and sodium sulfide. The digester is then sealed, and heated to cooking temperature by direct or indirect heating with steam. At the end of the cook, the pulp is discharged through a blow valve. Because all the pulping chemicals are charged at or before commencement of the cook, the degradation and removal of carbohydrates in the highly alkaline initial pulping phase tends to be accelerated. In such a process, the delignification rage and selectivity are strongly decreased after about one third of the cooking time because the effective alkali concentration decreases to about one third of the initial concentration, and lignin concentration in solution becomes increasingly higher.

In the mid-1980s, liquor displacement in kraft batch digester operations was introduced. Heat economy was the original driving force behind the development of this technology, as described in U.S. Pat. No. 4,601,787. This technique provided the possibility of extended delignification, and has been named by Beloit Corp. as the RDH® system as described by E. K. Andrews in 1989 TAPPI Pulping Conf., 1989, 607–625, and by Sunds Defibrator as the Super-Batch® system as described by S. Pursiainen TAPPI, 73(8), 1990, 115–122. It is generally suggested that the benefits in improved pulp strength delivery and the extent of delignification in liquor displacement technology are achieved by: (1) the high initial sulfide concentration resulting from warm and hot black liquor impregnation (Mera and Chamberlin, TAPPI, 71(1) 1988 132–136; Tormund and Teder, Int. Symp. Wood & Pulping Chem. 1989, 247–254), (2) the uniform chemical and temperature distribution in the digester during the cooking phase (Tikka and Kovasin CCPA Spring Conf. 1990, 1–9), and (3) the utilization of a modified effective alkali concentration profile during the different phases of cooking (Pu et al., APPATI, 44(6) 1991, p. 399). Further modification of this type of process has been proposed in U.S. Pat. No. 4,849,052 as: after the black liquor impregnation stage(s) the cooking stage is split into multi-cooking stages (generally 3±1 stages) to provide more even distribution of EA concentration, which in concept is similar to that used in Kamyr MCC and EMCC operations. The major drawback of these liquor displacement processes is the heavy capital investment.

Processes including a black liquor treatment stage before addition of white liquor were proposed to save cooking chemicals and achieve faster delignification rate several decades ago (U.S. Pat. No. 2,639,987), and investigated in detail recently by Engstrom et al (Paperi Ja Puu, 76(1), 1994, p. 59). Faster delignification was generally obtained after the black liquor pretreatment of wood chips. Air dried wood chips, however, were used in these processes. The results may not be valid for the wood chips used in pulp mills, which are generally wet, and contain 30–50% moisture. Further work suggests that when wet wood chips are used in this type of processes faster delignification is obtained, but no improvement of pulping selectivity or pulp viscosity is obtained. In addition, because no new cooking chemical is added to the black liquor, and the treatment time is relatively short, lignin removal during the black liquor treatment is minimal. The lignin concentration in the cooking liquor during the cooking period is about the same as that without black liquor pretreatment.

The most recent development in liquor displacement processes is the ENERBATCH® process (Wizani, 1992, TAPPI Pulping Conf. 1037–1046), which impregnates the wood chips with a strong white liquor under pressure to provide uniform chemical distribution in the chips.

In continuous cooking, a recent advance has been the Kamyr extended modified continuous cooking (EMCC®) process. Enhanced pulping selectivity has been attained by prolonged low-temperature counter-current cooking (Jiang et al., APPITA 1991, p. 221). The major changes from MCC® to EMCC® are reduced cooking zone temperature, increased washing zone temperature, and addition of white liquor to the washing zone. It has been suggested that the better , selectivity in this process is a result of the lower lignin concentration and temperature during cooking.

SUMMARY OF THE INVENTION

It is an object of this invention to provide an improved kraft pulping process.

In accordance with one aspect of the invention there is provided a process for kraft digestion of wood chips to form a cellulosic pulp comprising:

a) providing a kraft cooking liquor having a predetermined effective alkali (EA) concentration and a predetermined sulfidity, b) cooking wood chips in a first stage, in a cooking zone, with a first-stage cooking liquor comprising a first portion of said kraft cooking liquor of a) in admixture with a spent kraft cooking liquor, such that said first stage cooking liquor has an EA concentration less than said predetermined EA concentration in a), and a sulfidity higher than said predetermined sulfidity in a), to initiate pulp formation, with formation of by-product liquor, c) at completion of said first stage, displacing the by-product liquor from the cooking zone with a second-stage cooking liquor comprising a second, remaining portion of said liquor of a), in admixture with an aqueous diluent, such that said second stage cooking liquor has an EA concentration higher than the EA concentration of a partially spent liquor derived by employing the whole of the liquor of a) as first stage cooking liquor in b), and a lignin concentration lower than the lignin concentration of said partially spent liquor, and d) cooking the wood chips in a second stage, in said cooking zone, with said second-stage cooking liquor, to complete the pulp formation with production of a spent liquor.

In accordance with another aspect of the invention there is provided a process for producing a cellulosic pulp from wood chips in a kraft digestion comprising:

a) providing a kraft cooking liquor having a predetermined concentration of cooking chemicals, b) impregnating wood chips with a first-stage cooking liquor, said first-stage cooking liquor comprising a mixture of a first portion of said kraft cooking liquor of a) and a spent kraft cooking liquor, c) cooking the impregnated wood chips in the first stage cooking liquor, in a cooking zone, at an elevated cooking temperature to initiate pulp formation from said wood chips, with formation of a by-product liquor, d) displacing the by-product liquor from the cooking zone with a second-stage cooking liquor, said second-stage cooking liquor comprising a second, remainder portion of said kraft cooking liquor of a) and a wash liquid, e) cooking the wood chips in the second-stage liquor at an elevated cooking temperature to produce a cellulosic pulp and a spent liquor, and f) recycling said spent liquor formed in step e) to provide said spent kraft cooking liquor in step b).

The invention permits a more efficient use of a fresh kraft cooking liquor of predetermined chemical composition in a production of a cellulosic pulp by kraft digestion of wood chips. In a first cooking-stage the cooking is carried out with a portion of the fresh kraft cooking liquor mixed with spent liquor from a second cooking stage; and in a second cooking-stage the cooking is carried out with the remaining, portion of the fresh kraft cooking liquor mixed with an aqueous diluent.

In this way the first-stage cooking liquor has an EA less than that of the fresh kraft cooking liquor and a sulfidity higher than that of the fresh kraft cooking liquor and this permits the first-stage cooking to proceed with a reduced removal of carbohydrates and a reduced degradation of cellulosic material in the wood chips, as compared to that produced by employing the whole of the fresh kraft cooking liquor as the first stage cooking liquor.

The second-stage cooking liquor, on the other hand, has an EA concentration higher than the EA concentration of a partially spent liquor derived by employing the whole of the fresh kraft cooking liquor as first stage cooking liquor, and a lignin concentration lower than the lignin concentration of such partially spent liquor, such that the second-stage cooking has a delignification rate greater than that which would be provided by such partially spent liquor.

DETAILED DESCRIPTION OF THE INVENTION

This new kraft pulping process may be employed in conjunction with a batch digester or a continuous digester. When employed in a batch digester the process is sometimes referred to herein as the Papribatch process.

In the batch process, a batch digester is filled with wood chips and then sealed. The wood chips are steamed in a digester and after steaming, the first-stage cooking liquor, at a temperature of 70° C. to 90° C., is pumped from a first accumulator to the digester. The liquor-to-wood ratio is 3.5:1 to 5:1, generally 4:1. The first-stage liquor is made from the spent liquor from the second stage of the previous cook and a portion, typically 40 to 60%, preferably 50% of the fresh cooking chemicals which would be required for the complete cook in a conventional single stage cooking. This first stage liquor may thus contain 31–33 g/L of effective alkali (EA)as $Na_2O$, about 13 g/L of sodium sulfide as $Na_2O$, and 30–40 g/L of lignin. The digester is pressurized by nitrogen to 600 to 800 kPa, and the chips are pressure-impregnated for 20 to 40, generally 30 minutes. After the nitrogen pressure is released, the digester is heated to the cooking temperature of 160° to 180° C., preferably 170° C. in about 60 (±10) minutes by indirect heating with steam.

The first-stage cooking is continued for a time corresponding to an H-factor of 300 to 700, preferably 500 to 600 whereafter the first-stage liquor is displaced by the second stage liquor, which has been pre-heated to a cooking temperature of 160° to 180° C., preferably 170° C. The displacement by the second stage liquor is characterized by an apparent displacement ratio, defined as the volume of the second stage liquor added divided by the volume of the first stage liquor added, of about ⅞. The heat in the displaced first stage liquor can be recovered by using a heat exchanger, and the heat can be used to heat the second-stage cooking liquor. The displaced first stage liquor, containing 5–7 g/L EA and 70–80 g/L lignin, is then sent to the chemical recovery process. The second stage cooking liquor is made from fresh water or brownstock washer filtrate plus the remaining 60 to 40%, preferably 50% of the fresh cooking chemicals. The second stage liquor may thus contain 22–28 g/L of effective alkali (EA) as $Na_2O$, about 7.7–9 g/L of sodium sulfide as $Na_2O$, and 0–15 g/L of lignin; the second stage cooking is continued for a time corresponding to an H-factor of 700 to 1300, at a temperature of 160° to 180° C., preferably 170° C.

At the end of cooking, which is suitably between 1200 and 1800 H-factor depending on the target kappa number, the spent second stage liquor is displaced by a wash liquid which may be water or a brownstock washer filtrate. The washing phase is characterized by an apparent displacement ratio, defined as the volume of wash liquid divided by the volume of the second-stage liquor added, of 1/1. The heat in the displaced spent second-stage liquor can be recovered by using a heat exchanger to transfer the heat to the second-stage cooking liquor. The spent second stage liquor, which may contain 13–16 g/L EA, 6–7 g/L sulfide, and 40–50 g/L lignin, is then sent to an accumulator to be used as part of the first-stage cooking liquor in a subsequent cook. The cooked material is diluted with wash liquid and is pumped from the digester to the receiving tank.

In this new process, a uniform chemical distribution in the wood chips is obtained by the initial pressurized impregnation. At the start of the first-stage of cooking, the relatively low EA concentration (32 g/L in the new process vs. 38 g/L in the conventional process) and higher sulfidity (35% vs. 30%) reduces the amount of carbohydrate removal and degradation of cellulosic material. The relatively higher EA concentration profile (from 18 to 13 g/L vs. from 13 to 8 g/L), and the lower lignin concentration profile (from 15 to 45 g/L vs. from 40 to 70 g/L) during the second-stage of cooking are mainly responsible for a fast delignification rate. The combination of the new EA, sulfide, and lignin concentration profiles leads to faster delignification and preserved cellulose, or, in other words, a more selective delignification. This process can be used to extend delignification without increasing cooking time and chemicals, or to save cooking time and pulping chemicals in the production of pulps of conventional kappa number.

This pulping process can be applied in a conventional batch pulping system to obtain extended delignification with minimal modifications to the conventional system if the heat recovery is not considered. The steam consumption in such a configuration is expected to be somewhat higher than that in conventional batch systems because the second-stage cooking liquor has to be heated to cooking temperature. This deficiency can be minimized by heating the second-stage cooking liquor with the displaced black liquor via heat exchangers.

Application of this new pulping process to the existing liquor displacement batch cooking processes (RDH®, Super-Batch®) should provide further improvement in extending delignification, and saving cooking chemicals. The cooking should start after the hot black liquor fill with some cooking chemical make-up. At an H-factor between 500 and 600, the cooking liquor is replaced by hot white liquor. Compared with the original cooking cycle, the lignin concentration during the remaining two thirds of the cooking time will be much lower. Because the initial EA concentration in the hot black cooking liquor of the first stage and the cooking time in the first stage are fixed, the residual EA in the black liquor sent to recovery can be controlled at a constant level, no matter what total EA charge and H-factor are used.

Application of the pulping process in a Kamyr conventional continuous digester can also provide extended delignification and better pulping uniformity. To apply the new pulping process, the whole digester, including the washing zone, is operated at the same temperature, preferably in the range between 155° to 160° C., and co-currently. A new set of liquor transfer (extraction or addition) screens is added above or below the original black liquor extraction screens. The impregnated wood chips flow downwards and co-currently with first stage cooking liquor, and are partially cooked in the top part of the digester. At the end of the first stage of cooking, the black liquor or spent first stage liquor is extracted via the upper set of screens. Second stage cooking liquor is added into the digester via the lower set of screens. The partially cooked chips flow downwards with the second stage cooking liquor, and are cooked to completion in the lower part, including the washing zone, of the digester. No liquor or water addition is required at the bottom of the digester. The recovered spent second stage liquor from the downstream washing process is used to make the first stage cooking liquor.

Employing the process of the invention with 18.5% active alkali charge and 30% sulfidity, black spruce can be cooked to kappa number 22.3 with 1500 H-factor, which is 6–10 units, or 25–30% lower than that obtained with a conventional batch cooking process using the same chemical charge and H-factor. The viscosity of the pulp with kappa number 22.5 cooked by the modified procedure is 35 mPa.s, which is 8–10 mPa.s higher than that of a conventional pulp at the same kappa number.

Employing the process of the invention, it is possible to extend delignification to produce pulps having kappa numbers of 20 to 25 by kraft pulping, while employing the same cooking time and chemical charge which in a conventional batch cooking would produce a kappa number of only about 30.

Furthermore, the process can be employed to produce conventional kraft pulps having a kappa number of about 30, but with a reduced cooking time, thereby providing an increased pulp production rate with the same cooking equipment as conventionally employed.

Furthermore, the process of the invention can be employed to extend delignification to produce pulps having a kappa number of 13 to 18 by a nominal increase in the chemical charge and cooking time, without sacrificing pulp yield and strength.

Relatively modest changes are required to convert a conventional batch cooking system to a Papribatch cooking system, and much less change than is required to convert to the RDH®-type of processes.

Furthermore, by a moderate investment in pressurized liquor accumulators, heat recovery in the system may be achieved, thereby further improving the economics.

The existing RDH®-type systems can be modified to employ the process of the invention without additional equipment.

Application of the process of the invention to install RDH®-type systems should improve their performance by allowing greater extension of delignification and improved selectivity, because of the lower lignin concentration in the cooking liquor during the second-stage of cooking.

BRIEF DESCRIPTION OF DRAWINGS

The invention is further illustrated by reference to the accompanying drawings, in which.

DESCRIPTION OF PREFERRED EMBODIMENTS WITH REFERENCE TO THE DRAWINGS

Figure 1:
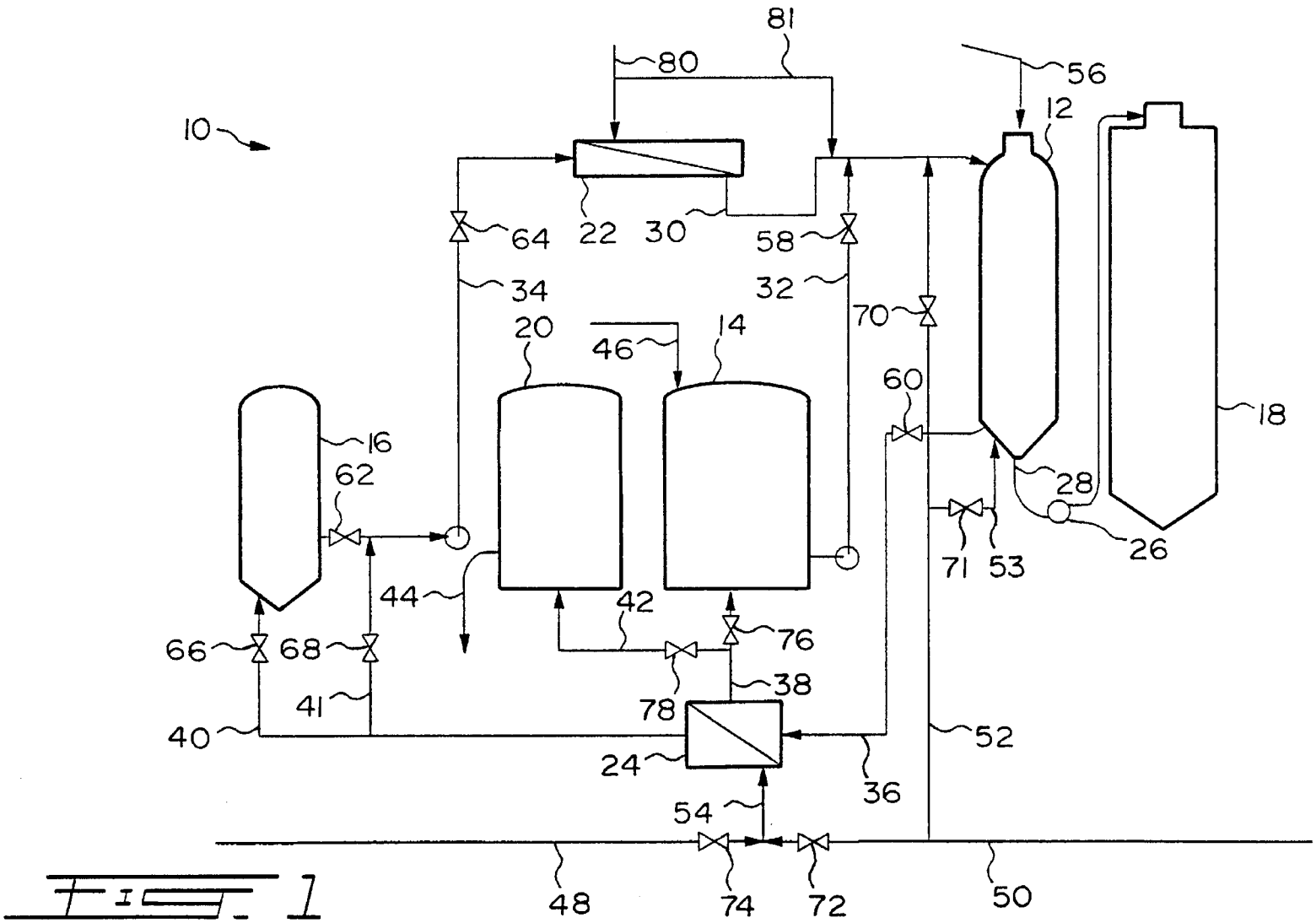
FIG. 1 illustrates schematically a system for carrying out the process of the invention.

With further reference to FIG. 1, there is shown a system 10, for carrying out a process of the invention.

System 10 includes a digester 12, a first-stage cooking liquor tank 14, a second-stage cooking liquor accumulator 16 and a blow tank 18.

System 10 further includes a black liquor tank 20, a steam heater 22 and a heat exchanger 24.

Digester 12 communicates with blow tank 18 via a blow line 28 having a blow pump 26.

Digester 12 has a digest inlet line 30, a digester outlet line 36 and a chip line 56.

The tank 14 has a tank outlet line 32 and a tank inlet line 38.

Accumulator 16 has an accumulator outlet line and an accumulator inlet line 40.

A black liquor branch 42 communicates tank inlet line 38 with black liquor tank 20.

Branch line 41 communicates accumulator inlet line 40 and accumulator outlet line 34.

White liquor lines 46 and 48 feed white liquor from a common source (not shown).

Digester 12 further includes a line 52 and a dilution line 53 which communicates with a washer filtrate line 50.

White liquor line 48 and washer filtrate line communicate with a feed line 54 to heat exchanger 24.

Steam line 80 communicates with heater 22.

Valve 58 is disposed in line 32 and valve 60 is disposed in line 36.

Valve 62 is disposed in accumulator outlet line upstream of branch line 41 and valve 64 is disposed in line 34 downstream of branched line 41.

valve 66 is disposed in accumulator inlet line downstream of branch line 41 and valve 68 is disposed in branch line 41.

Valve 70 is disposed in line 52 and valve 71 is disposed in dilution line 53 and valve 72 is disposed in washer filtrate line 50 downstream of dilution line 52.

Valve 74 is disposed in white liquor line 48.

Valve 76 is disposed in line 38 downstream of black liquor branch 42 and valve 78 is disposed in line 42.

In operation wood chips are introduced into digester 12 through chip line 56 to pack the digester 12.

Steam is introduced through line 81 to digester inlet line 30 and is employed to steam the wood chips in digester 12. During this operation valves 58, 60, 64 and are closed.

The white liquor requirement for cooking of the wood chips in digester 12 is calculated. A portion of the white liquor portion required for such cooking is fed through line 46 to tank 14 and a portion of spent liquor from the second stage cooking of an earlier operation is fed to tank 14 through tank inlet 38, having been previously passed from digester 12 through digester outlet line 36.

The cooking liquor developed in tank 14 may typically comprise 50% of the total white liquor requirement in admixture with the spent liquor from the second stage of the previous cooking operation. The liquor in tank 14 is fed through tank outlet line 32, valve 58 being open, to digester 12 wherein the first stage cooking is allowed to proceed.

At completion of the first stage cooking, valve 60 is opened and the liquor in digester 12 is displaced from digester 12 through digester outlet line 36, and with valve 76 closed and valve 78 open, the liquor is fed through lines 38 and 42 to tank 20 to be collected as black liquor from whence it passes through black liquor line 44 to a chemical recovery operation (not shown). Heat from the liquor is recovered via heat exchanger 24 by heating the white liquor from line 48, and washer filtrate from line 50 to be stored in the accumulator 16.

The liquor removed from digester 12 through line 36 is displaced by the second-stage cooking liquor from the accumulator 16, which liquor passes through lines 34 and 30, with valves 62 and 64 being open. The cooking liquor in accumulator 16 is formed from the remaining portion of the total white liquor requirement fed via lines 48, 54 and 40 with valves 74 and 66 being open, and washer filtrate which is fed through lines 50, 54 and 40 with valve 72 being open and valves 70 and 71 in digester wash lines 52 and 53 closed. The liquor in tank 16 has been heated to an elevated temperature and fed through line 34 and 30. The liquor may receive supplementary heat in passing through heater 22.

Thereafter the second stage cooking is conducted in digester 12. On completion of the second stage cooking, the liquor in digester 12 is displaced by washer filtrate introduced to digester 12 via line 52 with valve 70 open and valve 71 closed, the displaced liquor exiting digester 12 via digester outlet line 36 and being fed through line 38 with valve 76 open and valve 78 closed, to tank 14 to provide the spent liquor component of the cooking liquor developed in tank 14 for the first stage cooking of the next batch operation.

Thereafter valves 60 and 70 are closed and valve 71 being open, the pulp is diluted by washer titrate from line 53 and pumped out from digester 12 by pump 26 through blow line 28 into blow lank 18.

The heat energy recovered in heat exchanger 24 from the displaced first stage liquor may be employed to heat the white liquor from line 48 and wash filtrate from line 50 being fed through line 40 to the accumulator 16.

Similarly heat exchanger 24 may be employed to recover the heat from the displaced spent liquor from the second stage cook and this heat may likewise be employed for heating white liquor and wash filtrate from lines 48 and 72 being fed through line 40 to tank 16 to form a fresh second stage cooking liquor.

Figure 2:
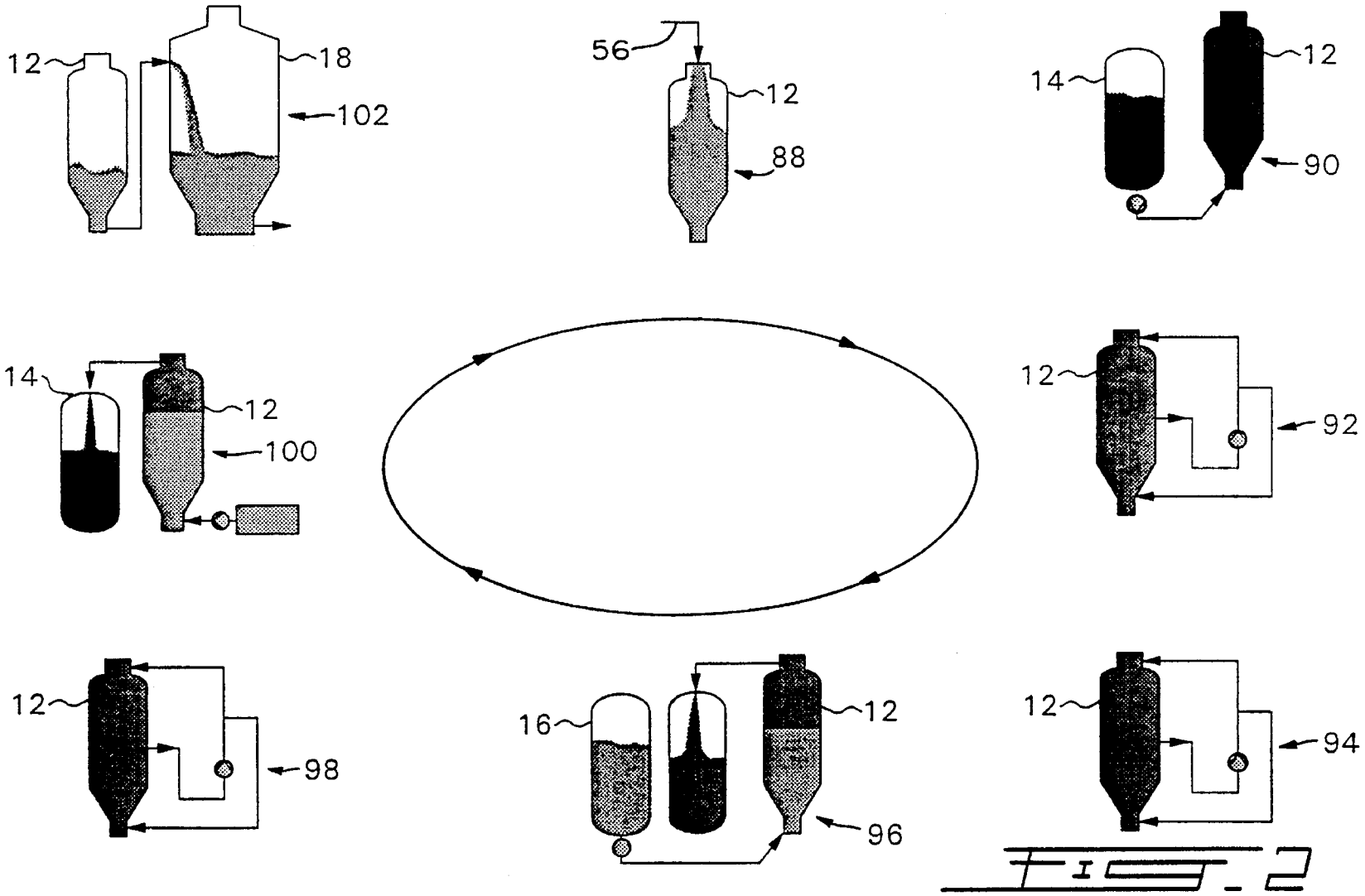
FIG. 2 is a flow chart of the Papribatch process.

With further reference to FIG. 2, there is illustrated schematically the Papribatch cooking having a chip fill stage 88, a first stage liquor fill 90, a heating stage 92 to elevated temperature, a first cooking stage 94, a liquor fill second stage 96 during which the first stage cooking liquor is displaced by the heated second stage cooking liquor, a second stage cooking 98, a displacement stage 100 in which the second stage cooking liquor is displaced and a pulp discharge stage 102.

In FIG. 2 the digester 12, tanks 14, 18 and 20 and accumulator 16 identified in FIG. 1 are shown with the same identification.

Arrows in the stages in FIG. 2 illustrate the fill, displacement and discharge operations.

Figure 3:
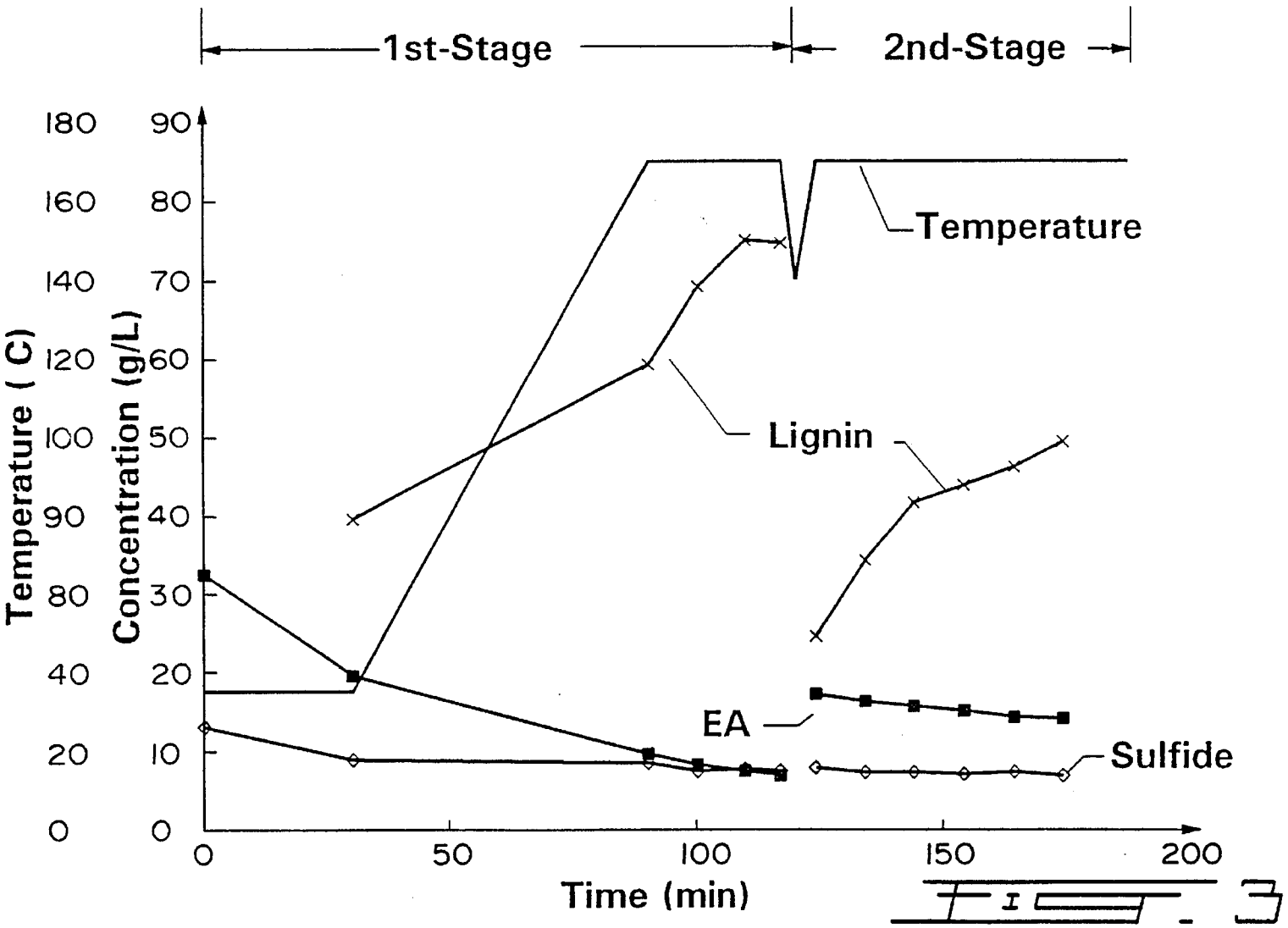
FIG. 3 illustrates graphically the obtained profiles of temperature, EA, lignin and sulfide concentrations achieved employing the process of the invention in a pilot digester.

With further references to FIG. 3 there is shown the profiles of temperature, EA, lignin and sulfide concentrations achieved during modified cooking performed in a pilot digester in accordance with the invention.

At the start of the first-stage of cooking, the relatively low EA concentration (32 g/L in the new process vs. 38 g/L in the conventional process) and higher sulfidity (35% vs. 30%) reduce the amount of carbohydrate removal and degradation of cellulosic material. The relatively higher EA concentration profile (from 18 to 13 g/L vs. from 13 to 8 g/L), and the lower lignin concentration profile (from 15 to 45 g/L v. from 40 to 70 g/L) during the second-stage of cooking are mainly responsible for a fast delignification rate.

FIG. 3 demonstrates that the combination of new profiles leads to fast delignification and preserved cellulose with more selective delignification.

Figure 4:
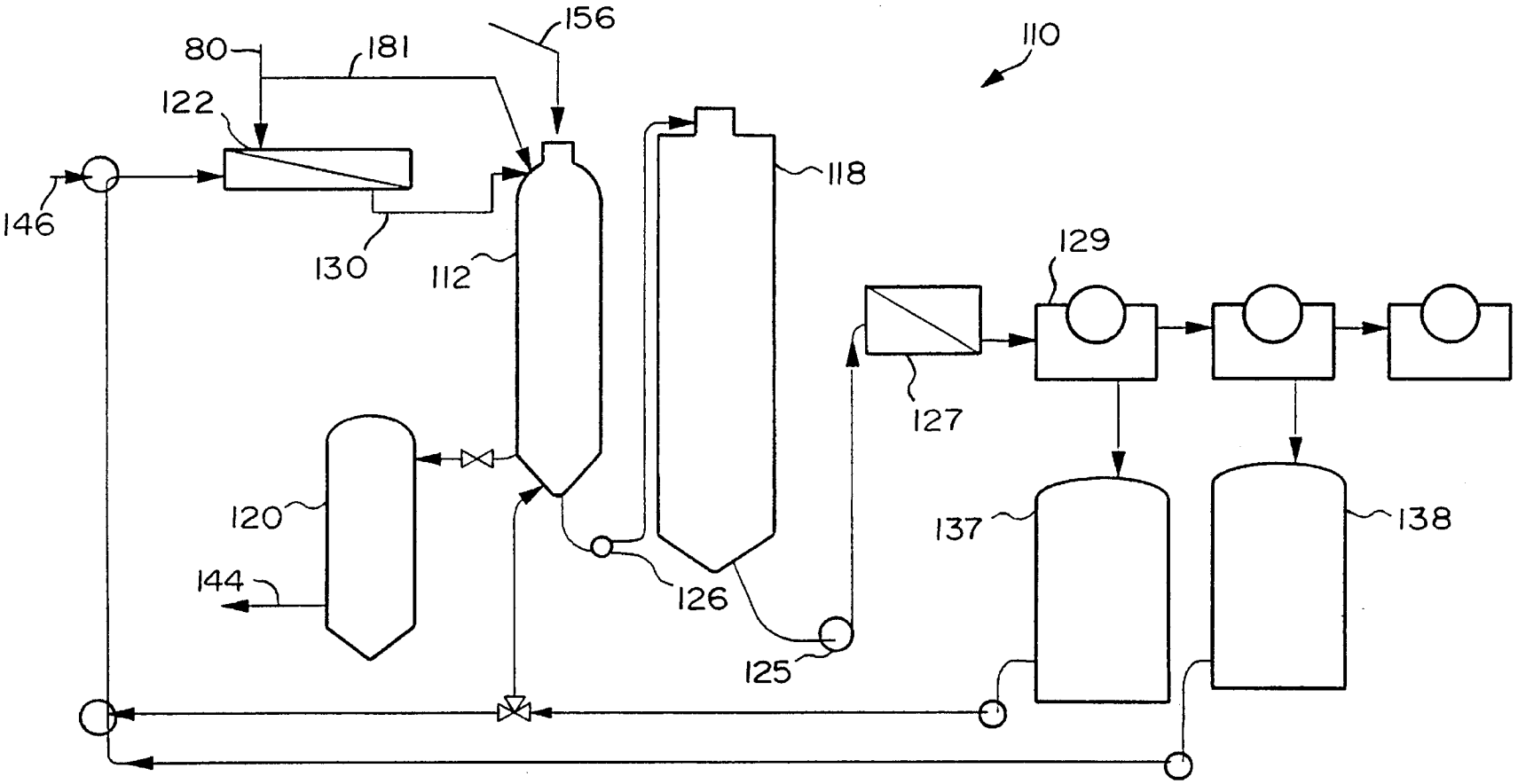
FIG. 4 illustrates schematically application of the process of the invention to a conventional batch pulping system to obtain extended delignification, with minimal modifications.

With further reference to FIG. 4, there is illustrated application of the pulping process of the invention in a conventional batch pulping system to obtain extended delignification with minimal modifications to the conventional system, the heat recovery not being considered.

In FIG. 4, elements of the system 110 which correspond to elements in FIG. 1, have the same integer identification but increased by 100. Thus system 110 includes digester 112, blow tank 118 and black liquor tank 120.

System 110 employs a first wash liquor storage tank 137 and a second wash liquor storage tank 138 in place of the tank 114 and accumulator 116, respectively, of system 10.

System 110 further includes a blow tank pump 125, knotter 127 and brownstock washers 129. System 110 is operated essentially as described for system 10 in FIG. 1 but without heat recovery steps.

Figure 9:
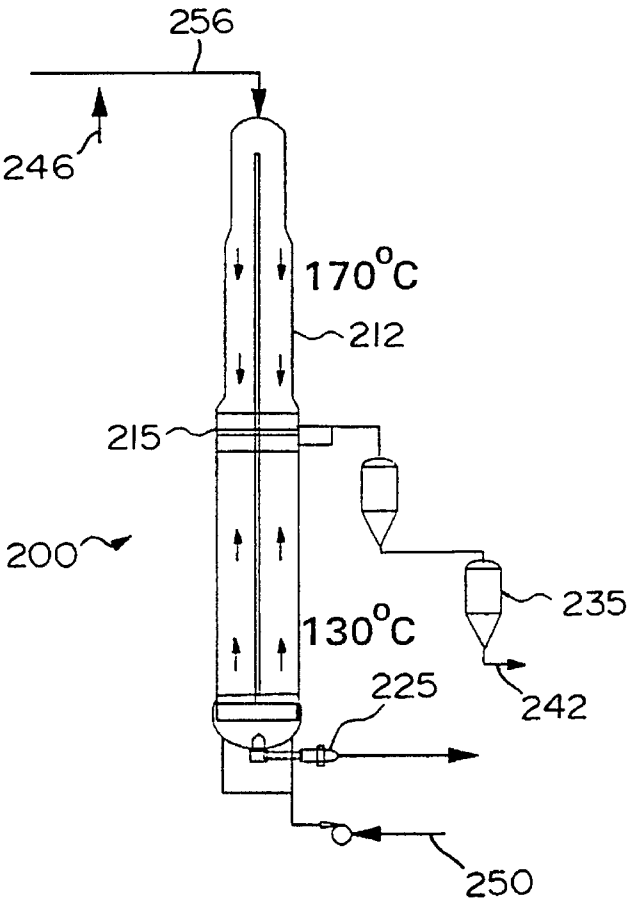
FIG. 9 illustrates schematically a conventional continuous cooking operation.

With further reference to FIG. 9, there is illustrated a conventional continuous digestion system 200. System 200 includes a column digester 212 having extraction screens 215, a pulp outlet 225 and flash tanks 235 for removal of black liquor (B.L.). Wood chips and white liquor are introduced at the top of digester 212 and flow downwardly towards screens 215, wash liquor is introduced at the bottom of column 210 and flows upwardly to extraction screens 215. The system typically operates at a digesting temperature of about 170° C. in the upper part of digester 212 above screens 215 and a temperature of about 130° C. in the lower part of digester 212 below screens 215 in the wash stage.

In accordance with the invention, system 200 is modified as system 300. Extraction screens 315 are incorporated in digester 212 below screens 215. Wood chips and first stage liquor are introduced at the top of digester 212 and second stage liquor is introduced via heater 245 to the extraction screens 315.

In the operation of the continuous system 300, the wood chips and first stage cooking liquor flow downwardly towards screens 215 and the chips are partially cooked in the upper part of the digester at a temperature of about 160° C.; the spent liquor from the first stage cooking is removed at screens 215 as in FIG. 9. Second stage cooking liquor is introduced to digester 212 via heater 245 and screens 315 and flows downwardly with partially cooked chips in digester 212 and the partially cooked chips are cooked to completion in the lower part of digester 212. This second stage cooking is also conducted at about 160° C. The spent liquor from the second stage cooking is removed in line 350 and cycled to form a component of the first stage liquor.

EXAMPLES

Example 1

This illustrates how Papribatch cooking reduces pulp kappa number and improves pulp viscosity under conventional cooking conditions: 1500 H-factor, 18.5% AA, and 30% sulfidity.

The cooking conditions and liquor compositions are shown in Table 1a. The results are summarized in Table 1b. The first data column of Table 1b shows the result of Papribatch cooking. The second column shows the results from the conventional batch process. It is evident that at the same cooking time and chemical charge, modified cooking reduced the kappa number by 6–8 units while maintaining the same viscosity. As in all extended delignification processes, there was a significant drop in yield. To reach the same kappa number with conventional cooking (data column 3), the cooking time at temperature has to be increased by 50%, and the pulp viscosity decreases significantly from the value obtained for Papribatch cooking (data column 1).

Example 2

This shows how a conventional kraft pulp of about 30 kappa number can be obtained with Papribatch cooking with a reduced cooking time (1200 H-factor).

The cooking conditions and liquor composition are shown in Table 2a. The results are summarized in Table 2b. To reach a conventional kappa number of 30, Papribatch cooking decreased the required cooking time at temperature by about 25% while improving pulp viscosity. The yield, however, was about 1% lower in the modified process. Comparing data columns 1 and 3, when the same cooking time and chemical charge were used in conventional cooking, the resulting pulp had a much higher kappa number (about 7 units).

Example 3

This demonstrates the potential of the Papribatch cooking method to extend delignification to low kappa numbers at slightly higher chemical charge and longer cooking time.

The cooking conditions and liquor composition are shown in Table 3a. The results are summarized in Table 3b. By increasing the EA charge on wood from 15% to 16%, and increasing the H factor from 1600 to 1800 by extending the cooking time, the kappa number was reduced from 30 to 16 (data column 1). When the same EA charge (16%) was used in conventional cooking (data column 2), cooking time had to be increased to 3200 H-factor to obtain a similar kappa number, while both the pulp yield and viscosity were significantly lower.

Figure 5:
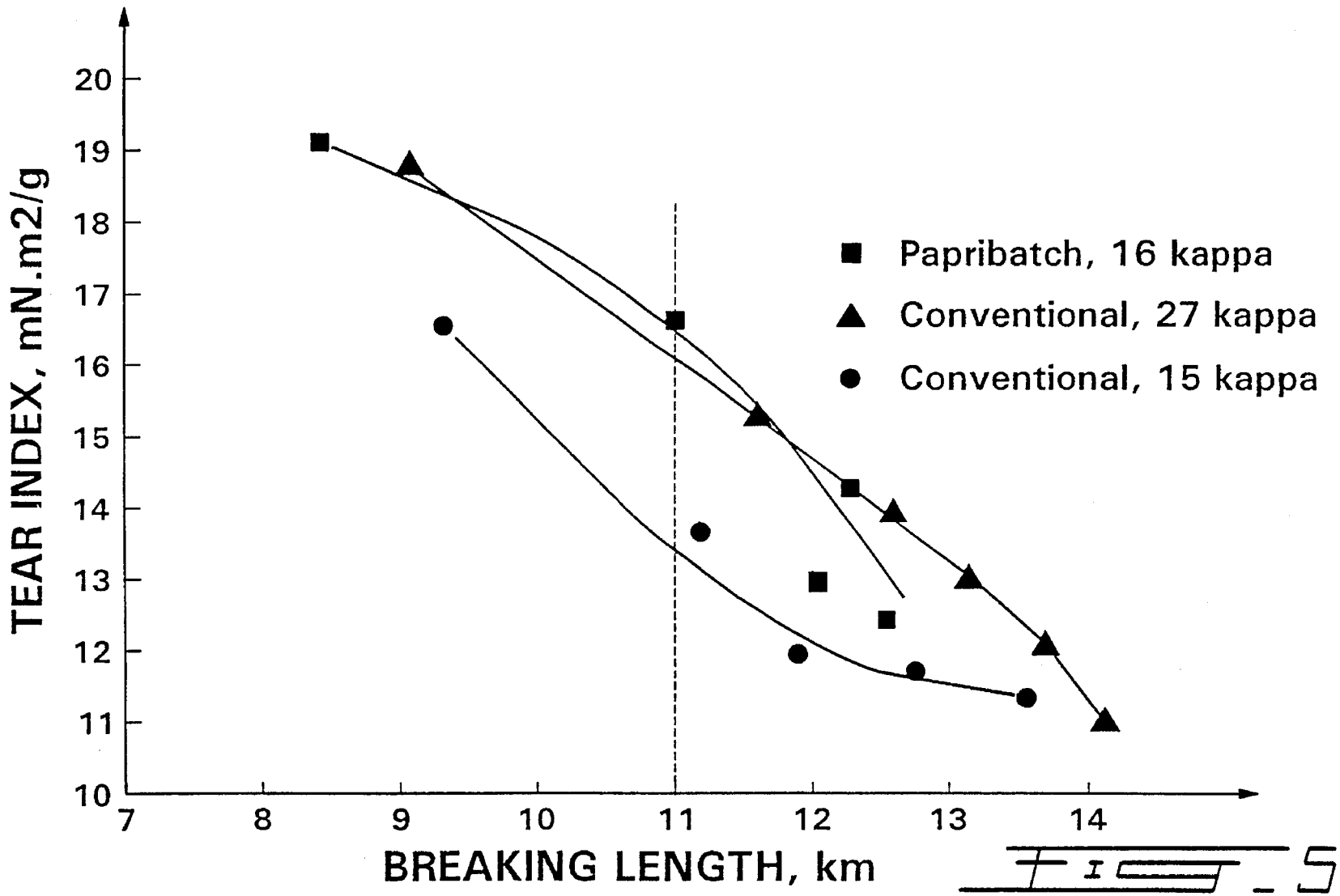
FIG. 5 illustrates graphically tear-tensile performance of pulps produced in accordance with the process of the invention.

FIG. 5 shows the tear-tensile performance of the three pulps listed in Table 3b. The tear-tensile strength of the pulp from the Papribatch process is quite close to that of conventional pulp delignified to a kappa number that ensures the highest possible strength. Published information indicates that the physical strength of conventional kraft pulps is highest within a kappa number range between 20 to 35 (MacLeod, 1991). The strength of the Papribatch pulp is well above the strength of the conventional pulp at a similar kappa number. The major difference between the Papribatch and conventional pulps in tear-tensile performance is that the values for Papribatch pulp are shifted to higher tear index and lower breaking length, suggesting higher α-cellulose content caused by a higher residual EA at the end of Papribatch cooking.

Figure 6:
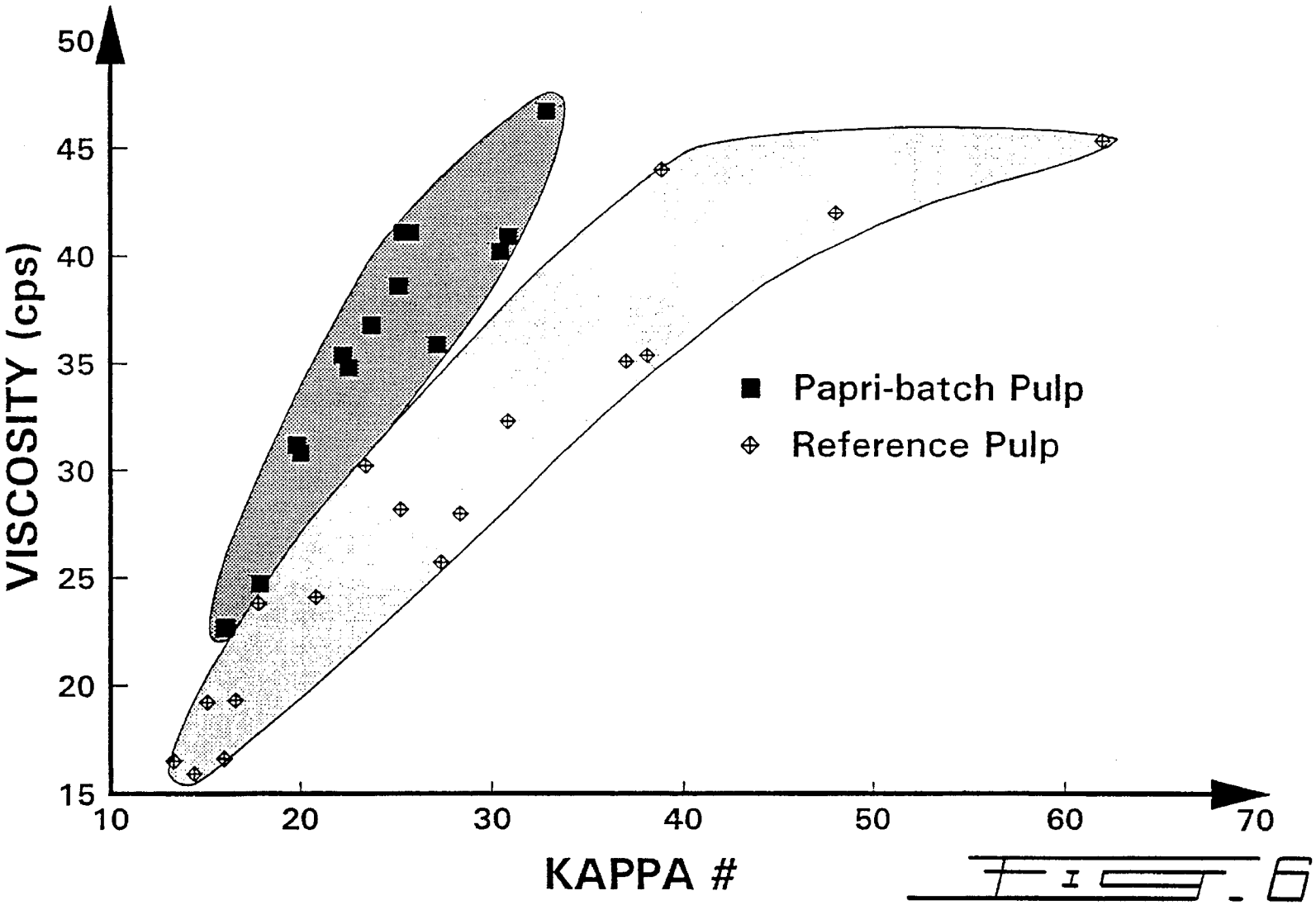
FIGS. 6 and 7 illustrate graphically the faster delignification and better cooking selectivity achieved with the Papribatch system.
Figure 7:
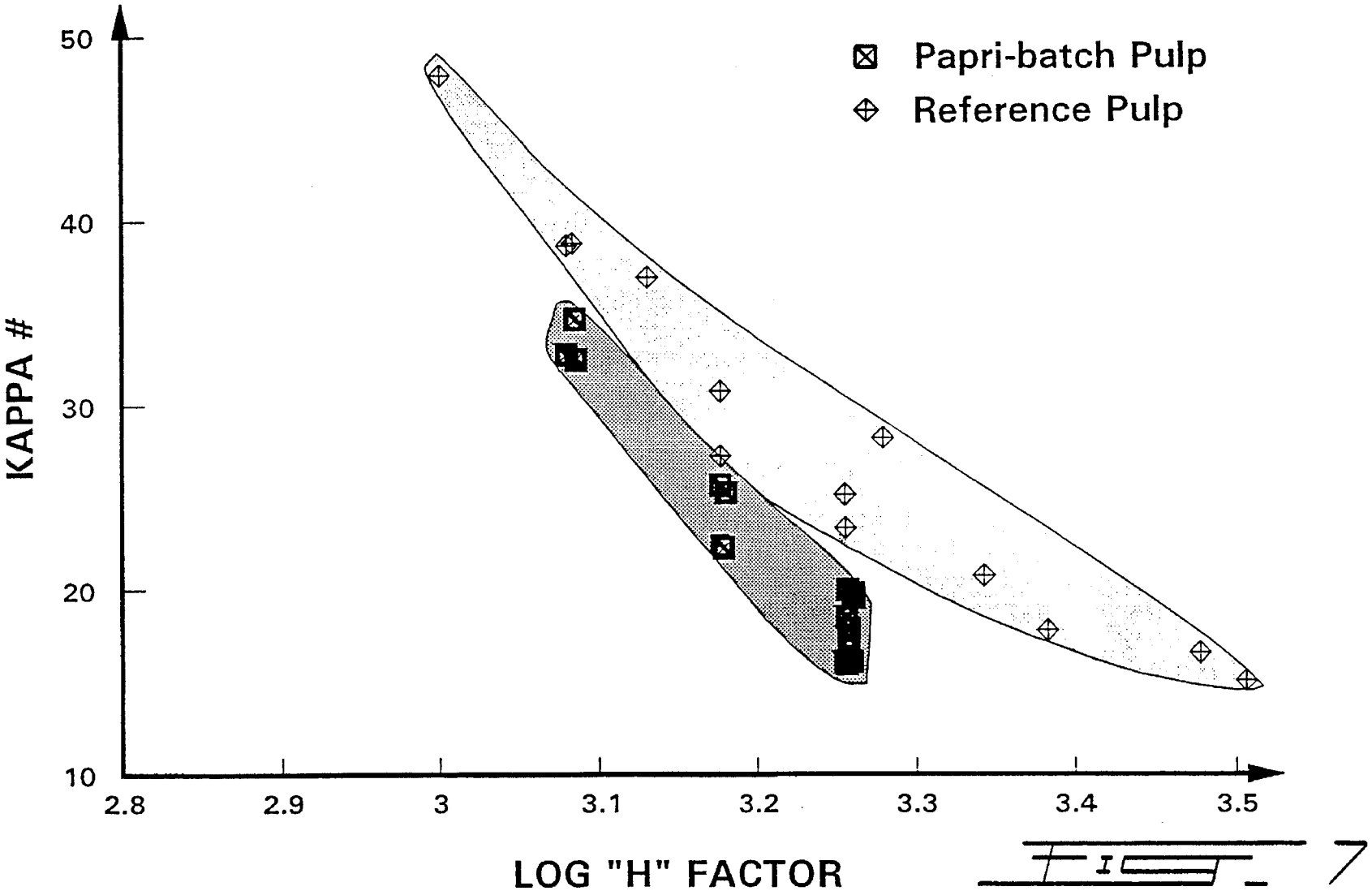
Figure 8:
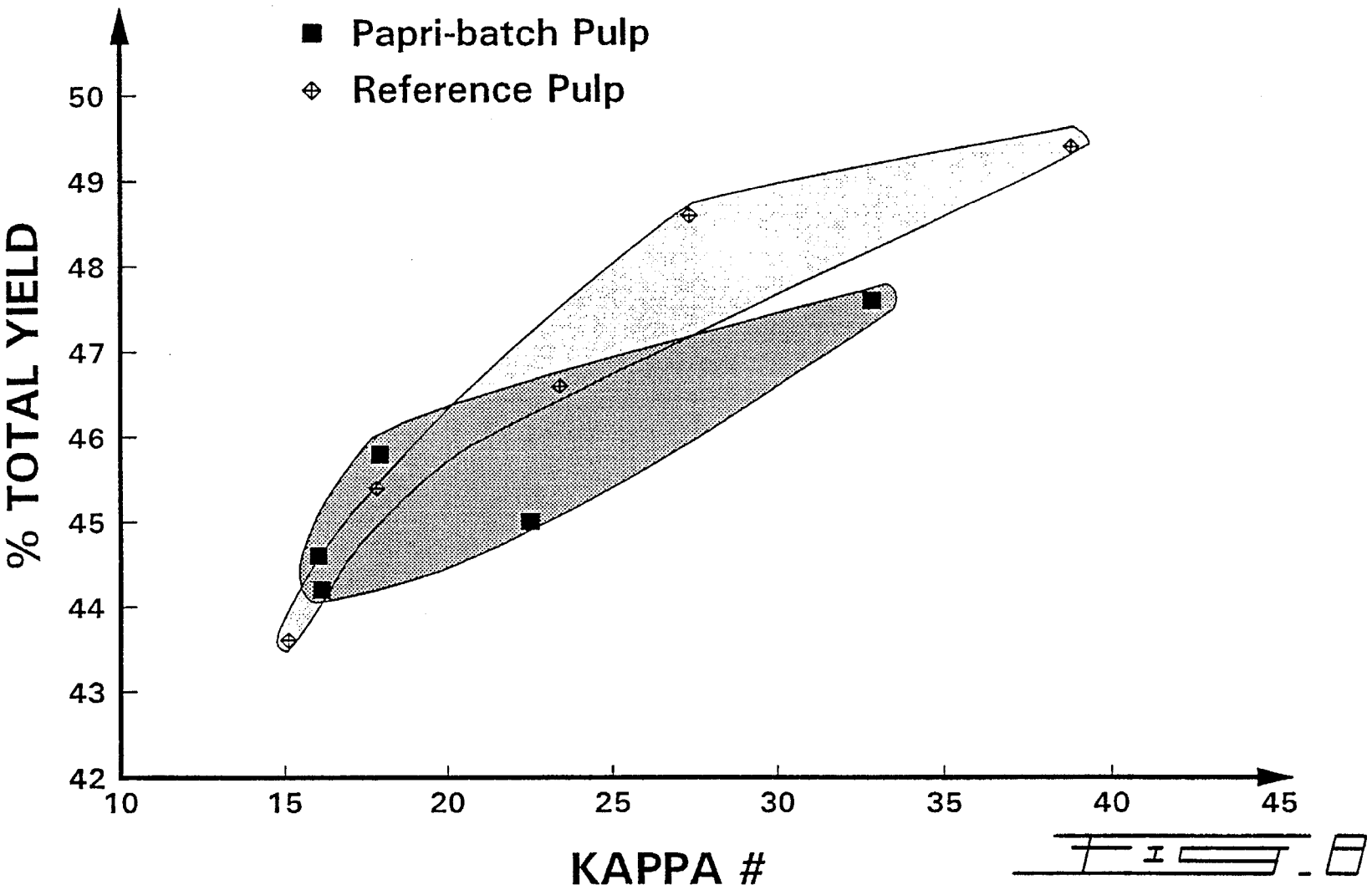
FIG. 8 illustrates that at kappa numbers below yield from the Papribatch system is better than that for the corresponding conventional single stage batch system.
Figure 10:
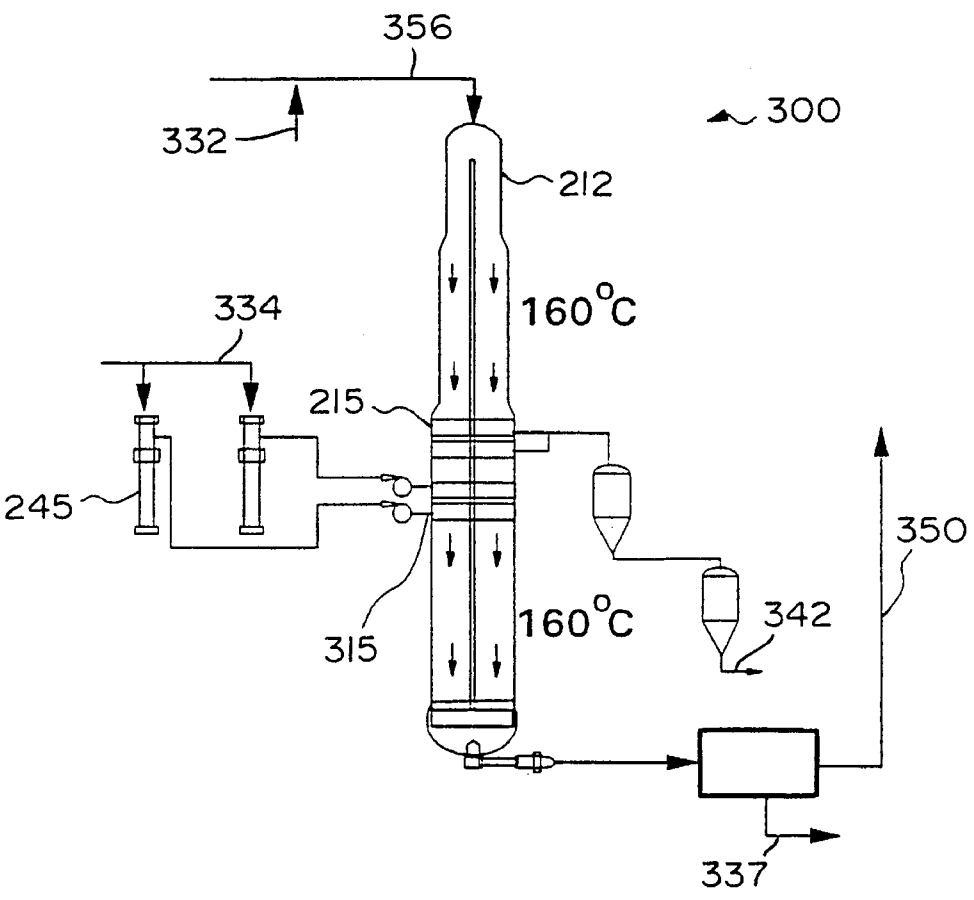
FIG. 10 illustrates the continuous operation of FIG. 9 modified in accordance with the invention.

Faster delignification and better cooking selectivity are generally obtained from Papribatch as shown in FIGS. 6 and 7. Pulp yield from Papribatch, however, is lower than conventional batch at kappa numbers over 20. At kappa numbers below 20, pulp yield from Papribatch becomes better than the yield from conventional batch as shown in FIG. 8.

TABLE 1a.

| Cooking Conditions | | |
|---|---|---|
| 1st-Stage | | |
| Cooking liquor: | EA: | 32 g/L |
| | Sulfide: | 13 g/L |
| | Lignin: | 40 g/L |
| which includes new | EA: | 20.4 g/L |
| make-up chemicals: | Sulfide: | 7.2 g/L |
| Liquor:Wood: | 4:1 | |
| H-factor: | 520 | |
| 2nd-Stage | | |
| Cooking liquor: | EA: | 21.8 g/L |
| | Sulfide: | 7.3 g/L |
| | Lignin: | 0 g/L |
| Total liquor exchange: | 6.9 L | |
| H-factor (total): | 1500 | |

TABLE 1b.

| | Results | | |
|---|---|---|---|
| | Modified | Ref. at same H | Ref. at same kappa |
| Liquor:Wood: | 4:1 | 4:1 | 4:1 |
| H-factor: | 1500 | 1500 | 2100 |
| Time at 170° C. (min): | 97 | 97 | 147 |
| EA charge on wood (%): | 18.5 | 18.5 | 18.5 |
| Kappa number: | 22.3 | 30.0 | 22.0 |
| Rejects (%): | 0.0 | 0.1 | 0.1 |
| Total yield (%): | 45.2 | 48.0 | 46.3 |
| Viscosity (mPa.s): | 35 | 35 | 26 |

TABLE 2a.

| Cooking Conditions | | |
|---|---|---|
| 1st-Stage | | |
| Cooking liquor: | EA: | 32 g/L |
| | Sulfide: | 13 g/L |
| | Lignin: | 50 g/L |
| which includes new | EA: | 18.8 g/L |
| make-up chemicals: | Sulfide: | 6.6 g/L |
| Liquor:Wood: | 4:1 | |
| H-factor: | 500 | |
| 2nd-Stage | | |
| Cooking liquor: | EA: | 25 g/L |
| | Sulfide: | 8 g/L |
| | Lignin: | 15 g/L |
| which includes chemicals | EA: | 4 g/L |
| from wash filtrate | sulfide: | 2 g/L |
| Total liquor exchange: | 7 L | |
| H-factor (total): | 1200 | |

TABLE 2b.

| | Results | | |
|---|---|---|---|
| | Modified | Ref at same kappa | Ref. at same H |
| Liquor:Wood: | 4:1 | 4:1 | 4:1 |
| H-factor: | 1200 | 1600 | 1200 |
| Time at 170° C. (min): | 78 | 103 | 78 |
| EA charge on wood (%): | 17.7 | 17.7 | 17.7 |
| Kappa number: | 32.5 | 32.0 | 39.0 |
| Rejects (%): | 0.3 | 0.2 | 0.1 |
| Total yield (%): | 47.6 | 48.7 | 49.2 |
| Viscosity (mPa.s): | 39 | 30 | 39 |

TABLE 3a.

| Cooking Conditions | | |
|---|---|---|
| 1st-Stage | | |
| Cooking liquor: | EA: | 33 g/L |
| | Sulfide: | 13 g/L |
| | Lignin: | 50 g/L |
| which includes new | EA: | 20 g/L |
| make-up chemicals: | Sulfide: | 7 g/L |
| Liquor:Wood: | 4:1 | |
| H-factor: | 600 | |
| 2nd-Stage | | |
| Cooking liquor: | EA: | 28 g/L |
| | Sulfide: | 9 g/L |
| | Lignin: | 15 g/L |
| which includes chemicals | EA: | 5 g/L |
| from wash filtrate | sulfide: | 2 g/L |
| Total liquor exchange: | 7 L | |
| H-factor (total): | 1800 | |

TABLE 3b.

| | Results | | |
|---|---|---|---|
| | Modified | Ref. at same kappa | Ref. at same H |
| Liquor:Wood: | 4:1 | 4:1 | 4:1 |
| H-factor: | 1800 | 3200 | 1800 |
| Time at 170 C (min): | 110 | 200 | 110 |
| AA charge on wood (%): | 18.7 | 18.8 | 18.8 |
| Kappa number: | 16.1 | 15.1 | 24.0 |
| Rejects (%): | 0.02 | 0.02 | 0.10 |
| Total yield (%): | 44.7 | 43.5 | 46.5 |

TABLE 3b.-continued

| | Results | | |
|---|---|---|---|
| | Modified | Ref. at same kappa | Ref. at same H |
| Viscosity (mPa.s): | 23 | 16 | 28 |

I claim:

1. A process for kraft digestion of wood chips to form a cellulosic pulp in first and second cooking stages comprising:

(a) providing a kraft cooking liquor having a predetermined effective alkali (EA) concentration and a predetermined sulfidity, (b) cooking wood chips in the first stage, in a cooking zone, with a first-stage cooking liquor comprising a first portion of said kraft cooking liquor of step (a) in admixture with a spent kraft cooking liquor from the second stage, such that said first stage cooking liquor has an EA concentration less than said predetermined EA concentration in step (a), and a sulfidity higher than said predetermined sulfidity in step (a), to initiate pulp formation, for a time corresponding to an H-factor of 300 to 700 with formation of by-product liquor, at completion of said first stage, said first portion comprising 40% to 60% of said kraft cooking liquor in step (a), (c) at completion of said first stage, displacing the by-product liquor from the cooking zone with a second-stage cooking liquor comprising a second, remaining portion of said liquor of step (a), in admixture with an aqueous diluent, such that said second stage cooking liquor has an EA concentration higher than the EA concentration of a partially spent liquor derived by employing the whole of the liquor of step (a) as the first stage cooking liquor in step (b), and a lignin concentration lower than the lignin concentration of said partially spent liquor, (d) cooking the wood chips from the first stage in the second stage, in said cooking zone, with said second-stage cooking liquor, to complete the pulp formation with production of spent liquor, and (e) recycling the spent liquor from step (d) to provide said spent kraft cooking liquor in step (b);

wherein the cooking in step (b) is at a temperature of 160° to 180° C. and cooking steps (b) and (d) have a total cooking time corresponding to an H-factor of 1200 to 1800.

2. A process according to claim 1, in which said aqueous diluent is water.

3. A process according to claim 1, in which said aqueous diluent is a brownstock washer filtrate.

4. A process according to claim 1, in which said H-factor in step (b) is 500 to 600.

5. A process according to claim 4, in which said first portion, in step (b), comprises 50% of said kraft cooking liquor in step (a) and said second portion, in step (d) comprises the remaining 50% of said kraft cooking liquor.

6. A process for producing a cellulosic pulp from wood chips in a kraft digestion in first and second cooking stages comprising:

(a) providing a kraft cooking liquor having a predetermined concentration of cooking chemicals, (b) impregnating wood chips with a first-stage cooking liquor, said first-stage cooking liquor comprising a mixture of a first portion of said kraft cooking liquor of step (a) and a spent kraft cooking liquor from the second cooking stage, said first portion comprising 40% to 60% of said kraft cooking liquor in step (a), (c) in the first cooking stage, cooking the impregnated wood chips in the first stage cooking liquor, in a cooking zone, at a cooking temperature of 160° to 180° C. to initiate pulp formation from said wood chips, with formation of a by-product liquor, for a time corresponding to an H-factor of 500 to 600, (d) displacing the by-product liquor from the cooking zone with a second-stage cooking liquor, said second-stage cooking liquor comprising a second, remainder portion of said kraft cooking liquor of step (a) and a wash liquid, (e) in the second cooking stage, cooking the wood chips from the first stage in the second-stage cooking liquor at a cooking temperature to produce a cellulosic pulp and a spent liquor, and (f) recycling said spent liquor formed in step (e) to provide said spent kraft cooking liquor in step (b);

wherein said cooking in steps (c) and (e) is for a total time corresponding to an H-factor of 1200 to 1800.

7. A process according to claim 6, further comprising displacing said spent liquor in step (e), from said cooking zone, with a wash liquid.

8. A process according to claim 5, wherein said impregnating in step b) is at a temperature of 70° to 90° C., a liquor:wood chips ratio of 3.5:1 to 5:1 and under a pressure of 600 to 800 kPa, to effect pressure impregnation of said wood chips with said first-stage cooking liquor.

9. A process according to claim 1, wherein said second-stage liquor in step (d) is at a temperature of 160° to 180° C. and said elevated cooking temperature in step (e) is 160° to 180° C.

10. A process according to claim 6, wherein said wash liquid is water.

11. A process according to claim 6, wherein said wash liquid is a brownstock washer filtrate.

12. A process according to claim 6, wherein i) said first-stage cooking liquor has a concentration of cooking chemicals less than said predetermined concentration in step (a) and has an effective alkali (EA) concentration lower than that of said liquor in step (a), and a sulfidity higher than that of said liquor in step (a); and ii) said second-stage liquor has a concentration of cooking chemicals less than said predetermined concentration in step (a) and has an EA concentration higher than the EA concentration of a partially spent liquor derived by employing the whole of the liquor of step (a) as a first-stage cooking liquor in step (b), and a lignin concentration lower than the lignin concentration of said partially spent liquor.

13. A process for producing a cellulosic pulp by kraft digestion of wood chips in first and second cooking stages comprising:

(a) providing a fresh kraft cooking liquor having a predetermined effective alkali (EA) concentration and a predetermined sulfidity, (b) impregnating wood chips at an elevated temperature and pressure, with a first-stage cooking liquor in a cooking zone, said first stage cooking liquor comprising a mixture of a spent kraft cooking liquor from the second cooking stage and a first portion of said fresh kraft cooking liquor of step (a), said first-stage cooking liquor having an effective alkali (EA) concentration lower than that of said liquor in step (a), and a sulfidity higher than that of the liquor in step (a), effective to provide a reduced removal of carbohydrates and a reduced degradation of cellulosic material in said wood chips, as compared to that produced by employing the whole of the liquor of step (a) as the first stage cooking liquor, said first portion comprising 40% to 60% of said kraft cooking liquor of step (a), (c) releasing the elevated pressure, in said first cooking stage and cooking the impregnated wood chips, in said cooking zone, with said first-stage cooking liquor in a first stage cooking, at a temperature of 160° to 180° C. for a time corresponding to an H-factor of 500 to 700, to initiate conversion of the wood chips to cellulosic pulp, with formation of by-product liquor, (d) at completion of said first-stage cooking, displacing the by-product liquor from said cooking zone with a second-stage cooking liquor having a temperature of 160° to 180° C., said second-stage cooking liquor comprising a second, remaining portion of said liquor of step (a), in admixture with an aqueous diluent selected from the group consisting of water or brownstock washer filtrate; said second-stage cooking liquor having an EA concentration higher than the EA concentration of a partially spent liquor derived by employing the whole of the liquor of step (a) as the first stage cooking liquor in step (b), and a lignin concentration lower than the lignin concentration of said partially spent liquor, such that the second-stage cooking has a delignification rate greater than that which would be provided by said partially spent liquor, (e) cooking the wood chips from the first stage, in the second-stage cooking, in the second-stage cooking liquor, in said cooking zone, at a temperature of 160° to 180° C. to produce a cellulosic pulp and a spent liquor, (f) at completion of said second-stage cooking, displacing the spent liquor from said cooking zone, and (g) recycling the displaced spent liquor from step (f) to provide said spent kraft cooking liquor in step (b);

wherein the cooking in steps (c) and (e) is for a total cooking time corresponding to an H-factor of 1200 to 1800.

14. A process according to claim 13, wherein said H-factor in step (b) is 500 to 600.

* * * * *